United States Patent [19]

Bente

[11] Patent Number: 4,470,207

[45] Date of Patent: Sep. 11, 1984

[54] SPORTS SHOE OR BOOT

[75] Inventor: Alfred Bente, Herzogenaurach, Fed. Rep. of Germany

[73] Assignee: Messrs. Adidas Sportschuhfabriken Adi Dassler KG, Fed. Rep. of Germany

[21] Appl. No.: 419,917

[22] Filed: Sep. 20, 1982

[30] Foreign Application Priority Data

Dec. 4, 1981 [DE] Fed. Rep. of Germany ..... 3148038

[51] Int. Cl.[3] ..... A43B 5/00; A43C 15/16

[52] U.S. Cl. ..... 36/134; 36/59 R; 36/61; 36/62; 36/65

[58] Field of Search ..... 36/59 R, 59 A, 59 B, 36/61, 62, 65, 134

[56] References Cited

U.S. PATENT DOCUMENTS

| | | | |
|---|---|---|---|
| 2,911,738 | 11/1959 | Clerke | 36/134 |
| 3,082,549 | 3/1963 | Dolceamore | 36/134 |
| 3,484,957 | 12/1969 | Druichet | 36/134 |
| 3,553,858 | 1/1971 | Austin | 36/134 |
| 4,178,702 | 12/1979 | Mayer | 36/59 R |

FOREIGN PATENT DOCUMENTS

| | | | |
|---|---|---|---|
| 1912804 | 7/1971 | Fed. Rep. of Germany . | |
| 2313646 | 10/1974 | Fed. Rep. of Germany . | |
| 2810363 | 9/1979 | Fed. Rep. of Germany | 36/134 |

*Primary Examiner*—Werner H. Schroeder
*Assistant Examiner*—Steven N. Myers

[57] ABSTRACT

A sports shoe or boot has a sole of flexible plastic material, with gripping projections or studs of a wear-resistant material thereon; disposed between the sole and a bearing surface on the projection is a compressible ring member, to produce a cushioning effect.

6 Claims, 2 Drawing Figures

SPORTS SHOE OR BOOT

BACKGROUND OF THE INVENTION

The present invention relates generally to a sports shoe or boot, such as a football shoe or boot or the like, including an outer sole comprising resiliently flexible plastic material, and projections such as studs or bars comprising a wear-resistant plastic material, on the sole. For the sake of simplicity herein, the term sports shoe will be used to cover any appropriate form of sports shoe, sports boot (being generally of a heavier construction than a sports shoe in the narrow sense) and the like.

Sports shoes having gripping projections on the underneath of the sole thereof are generally particularly intended for use in field-type sports, such as football and the like. One such form of sports shoe may have calks or studs of comparatively hard material, for example polyamide, which are replaceably secured to the sole. The shoe usually has a comparatively small number of such projections (for example, up to six or eight projections). Alternatively, a sports shoe may be provided with a larger number (for example up to around 20) of studs or projections which are normally formed by casting or moulding integrally with the sole. The material used for the projections and thus for the sole is comparatively soft and yielding, in order to give greater resiliency in contact with the ground. The present invention is more particularly concerned with sports shoes of the second kind referred to above. Such sports shoes are advantageous over the first-mentioned shoes or boots which have replaceable studs or the like, insofar as the larger number of projections and the more pronounced flexibility and resiliency of the material used for the sole mean that contact between the shoe and the ground is more uniform, giving rise to a more even spread of the loading applied by the body of the person wearing the shoe, while also imparting a certain degree of flexibility or compliance to the sole of the boot or shoe, which also contributes to making the boot or shoe more comfortable to wear in particular on hard ground such as on frozen sports fields and the like. For that reason, boots or shoes of that kind are used in particular as training shoes by footballers.

However, a disadvantage of sports shoes or boots of the above-discussed kind, wherein the sole and the studs or projections thereon are formed integrally from the same material is that the material which desirably experiences resilient deformation under pressure, to provide greater comfort in wearing the boot or shoe, is susceptible to a comparatively high rate of wear. Therefore, either the soles and the projections must all be made from high-strength and therefore expensive plastic materials, or alternatively the studs or projections must be made from a different material from the material for the sole, which therefore has a considerably higher degree of resistance to wear, with the projections possibly being replaceable, in a similar manner to the studs of the first kind of boot or shoe referred to above (see for example the constructions disclosed in German Utility Model No 18 99 723 or French patent specification No 2 070 253). However, the constructions set forth in the documents just mentioned have not been successful under practical circumstances because the projections, made from the wear-resistant material, are comparatively unyielding and therefore a shoe constructed in that manner loses a substantial part of its shock-absorbing properties or, if the projections are formed merely by a comparatively thin shell of the high-strength material referred to above, which is screwed on to screwthreaded projections on the underneath of the sole, the shells nonetheless suffer from wear at a relatively high rate. In this connection, there is then even the danger that the screwthreaded fittings on the underneath of the sole themselves suffer damage so that the sports shoe is rendered useless as a result.

SUMMARY OF THE INVENTION

An object of the present invention is to provide a sports shoe having projections which are substantially resistant to wear but which nonetheless give comfortable contact with the ground.

Another object of the present invention is to provide a sports shoe wherein the predominant part of the sole thereofcomprises a comparatively inexpensive plastic material and the projections or studs thereon comprise a material which has a considerably higher degree of wear-resistance.

Yet another object of the present invention is to provide a sports shoe which enjoys an enhanced service life in respect of the studs or projections on the underside thereof, without the shoe losing its desired shock-absorbing properties.

Still a further object of the present invention is to provide a design of sports shoe sole structure which can be applied both to projections formed integrally with the sole of the shoe and to projections or studs which are replaceably secured to the sole.

These and other objects are achieved by a sports shoe such as a football shoe or boot comprising an outer sole which consists of a resiliently flexible plastic material, having projections or studs comprising a wear-resistant material on the underneath of the sole. A resiliently compressible annular portion is disposed between the sole and a bearing surface on the projections or studs or the like, which is towards the sole.

It will be seen therefore that the annular portion which can be deformed resiliently by pressure applied thereto not only permits a certain degree of compression in the axial direction of the projection, stud, calk or the like which bears thereagainst, but it also permits the projection, stud or the like to tilt resiliently, by experiencing deformation on one side. As a result, when the shoe is subjected to a perpendicular loading or a lateral loading or a combination of such loadings, particularly on rough or bumpy and hard playing grounds, the shoe has a damping or shock-absorbing capability which is at least equivalent to that of boots or shoes with soles and projections carried thereon, comprising a soft yielding material. However, with the construction in accordance with the present invention, the wear resistance of the studs or projections is considerably increased because the resiliently compressible annular portion permits the studs or projections to be in the form of shell members of greater thickness than hitherto, so that they have a correspondingly prolonged service life.

It should be noted that the basic concept of the present invention may be embodied both with studs or projections which are non-releasably fitted to the sole of the shoe, and also studs or projections which are releasably fitted in place. It will be appreciated that the properties of the studs or projections or the like may be adapted to the optimum requirements in respect of the sports shoe, for example the purpose for which the shoe or boot is to be worn, with the studs or projections comprising for example a comparatively hard material while nonetheless having the kind of typical flexibility usually associated with the projections formed integrally with a sports shoe sole.

In manufacture of a sole for a sports shoe, in accordance with the invention, the shell portions forming the projections, studs or the like, with an axial recess therein, and the associated annular portion, are placed in a casting mould and the plastic material for forming the sole is then introduced into the mould around the components therein in the appropriate manner, as by injection for example. The plastic material passes through the annular portion and flows into the axial recess provided in the respective stud, projection or the like, which may be provided with a screwthread or with undercut portions so that after the plastic material has set, the shell portions forming the studs, projections or the like are releasably or non-releasably connected to the sole, as appropriate.

An advantageous feature of the present invention provides that the bearing surface of the stud, projection or the like is of a frustoconical shape which tapers inwardly towards the sole of the shoe or boot, with the annular portion having a recess which is of a correspondingly complementary configuration. That arrangement means that the stud, projection or the like is held in a precisely centered position relative to the annular portion, while in addition the outer edge of the annular portion is of increased axial thickness which further contributes to good resilient deformability thereof. In addition, in accordance with another preferred feature of the invention, in order to give improved fixing of the stud, projection or the like to the sole of the boot or shoe, in regard to forces acting at least substantially in the plane of the sole, the annular portion may be disposed in a flat or shallow recess or depression in the underside of the sole, to give enhanced location thereof. The depression or recess may also be formed directly in the casting or moulding operation when manufacturing the sole, by using a mould of suitable configuration.

Further objects, features and advantages of the present invention will be apparent from the following description and claims and the accompanying drawings.

DESCRIPTION OF THE PREFERRED EMBODIMENT

Figure 1:
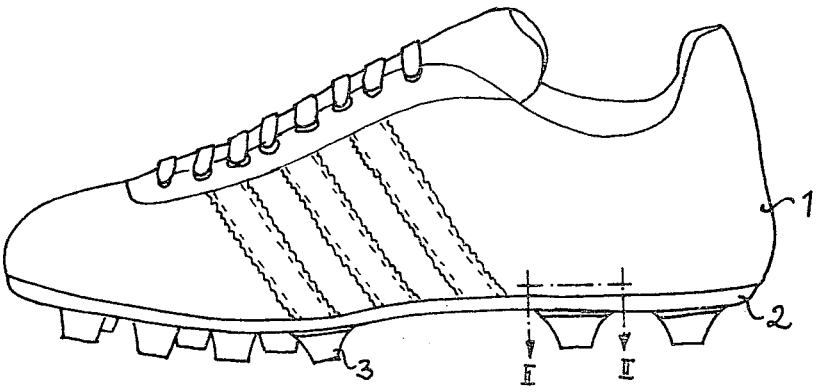
FIG. 1 shows a side view of a football shoe or boot having a sole in accordance with the principles of this invention.

Referring firstly to FIG. 1, shown therein is a football boot or shoe which is of a generally typical construction, comprising an upper portion 1, a sole 2 which is cast or moulded directly thereon, comprising a suitable material such as PVC, and studs or projections 3 on the underside of the sole 2. There are four such studs or projections 3 under the heel portion of the boot or shoe, while there are nine studs or projections 3 on the front main part of the sole.

Figure 2:
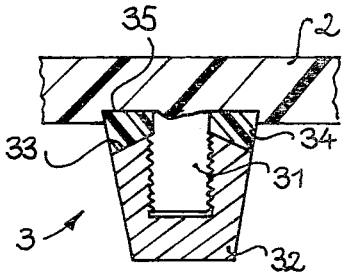
FIG. 2 shows a view on an enlarged scale and in longitudinal section taken along line II—II in FIG. 1 of an individual stud or projection.

Reference will now also be made to FIG. 2 which shows that, at the locations at which studs or projections 3 are provided, the sole 2 has downwardly projecting screwthreaded projections or portions 31 which are formed integrally with the sole 2. Shell member 32 defining the respective studs or projections, comprising a highly wear-resistant plastic material such as polyurethane can be screwed on to the screwthreaded projections 31. The shell portions 32 which may also comprise metal are provided at their upper end, being the end which is towards the sole 2, with a bearing or support surface 33 which is of a generally frustoconical configuration as illustrated. Disposed between the sole 2 and the shell portion 32 of the respective stud or projection 3 is an annular portion or ring 34 comprising a resiliently compressible material such as rubber, with the surface 33 of the shell portion 32 bearing against the adjoining surface of the annular portion 34. For that purpose, the annular portion 34 has at that position a recess or depression which is of a complementary configuration to the above-mentioned surface 33, so that the surface 33 is precisely fitted into and centered in the recess in the annular portion 34.

In addition, the underside of the sole 2 has a flat or shallow depression 35 into which the annular portion 34 is in turn precisely fitted. This therefore enhances locating the stud or projection 3 in relation to the sole 2, so that it can more readily withstand forces acting thereon in use of the shoe or boot. The edge of the depression 35 may also taper inwardly in a downward direction, thereby forming an undercut configuration to the depression 35, whereby the annular portion 34 is positively secured in place therein.

Precise fitting of the components 31, 32 and 34 to each other and to the sole 2 is achieved by the sole, which comprises a material such as PVC, being produced by an injection moulding process, with the shell portions 32 and the annular portions 34 being disposed in the mould from the beginning of the moulding operation. In the course of moulding, the PVC material for forming the sole 2 passes through the annular portion 34 and penetrates into the recess in the shell portion 32, thereby forming the screwthreaded projection or fitment 31. As a result of the moulding pressure which occurs in the moulding operation, the annular portion 34 which comprises rubber is compressed so that, when the shoe is removed from the mould, the annular portion 34 is subjected to a pre-stressing effect which prevents the shell portion 32 from becoming unintentionally loosened on the projection 31.

As the sole 2 is subjected to a comparatively low wear loading, in comparison with the studs or projections 3, the sole 2 may be made from a comparatively inexpensive material such as PVC. On the other hand, the shell portions 32 which form the studs or projections 3 are subjected to a high wear loading and accordingly advantageously comprise a highly wear-resistant PU-material. The thickness of the shell portion 32 is such that it gives a comparatively long service life, even on hard and abrasive playing surfaces. In spite of the comparatively hard and resistant PU-material forming the shell portions 32, the sole 2 generally is relatively soft and yielding to walk upon, and also has resilient flexibility in a direction parallel to the surface of the sole, as the annular members 34 of rubber experience resilient deformation when loadings are applied thereto. The screwthreaded fitments 31 of PVC do not prevent such deformation.

Instead of the screwthreaded fitments 31 being formed integrally with the sole 2, as in the illustrated embodiment, it is also possible for the screwthreaded fitments 31 to be made from a material which is stronger than that of the sole 2, with the fitments then being disposed on small support plates and joined to the shell portions 32 from the outset, that is to say, before the moulding or casting operation. When the unit comprising the screwthreaded fitment, including the support plate, with the shell portion thereon, is placed in the mould, the plastic material for forming the sole flows around the support plates and embeds them in the sole in known manner.

It may also be possible for annular members 34 of different degrees of hardness to be used depending on the sizeof the shoe and thus depending on the body weight of the person wearing the shoe, which is usually generally related to the shoe size. The hardness of the sole material is usually in the range of from 77 to 80 Shore; in order to give the desired effect, the hardness of the rubber for the annular portions 34 should be in the range for example of between approximately 40 and 60 Shore.

Various other modifications an alterations may be made in the above-described preferred embodiment of the invention, without departing from the spirit and scope thereof. It will also be appreciated that, although the studs or projections 3 illustrated in the drawing are of a generally round and thus typical stud configuration, projections of a different configuration from that illustrated may be employed without thereby departing from the spirit of the invention, for example projections of a generally short bar-like configuration, and the like.

What is claimed is:

1. A sports shoe including a sole comprising a resilient, flexible, soft, plastic material having substantially similar properties as PVC with respect to deformability and elasticity, ground engaging projections comprising a wear-resistant material which is relatively harder than said sole, and having substantially similar properties as polyurethane with respect to deformability and elasticity on the sole, a resiliently compressible annular member disposed between the sole and a surface portion of each said projection, fitments formed integrally with said sole, and means on each of said projections and said fitments to secure the projections on the fitments.

2. A shoe as set forth in claim 1, wherein each fitment is screwthreaded, and each said projection is adapted to be screwed on to a screwthreaded fitment on the sole.

3. A shoe as set forth in claim 1 wherein said annular member is disposed in a recess in the surface of the sole.

4. A shoe as set forth in claim 1 wherein said annular member comprises rubber.

5. A sports shoe including a sole comprising a resiliently flexible plastic material, ground engaging projections comprising a wear-resistant material on the sole, a resiliently compressible annular member disposed between the sole and a surface portion of each said projection, said surface portion of each said projection being of a generally frustoconical configuration which tapers inwardly towards said sole, fitments formed integrally with said sole, and means on each of said projections and said fitments to secure the projections on the fitments.

6. A shoe set forth in claim 5 wherein said annular member has a recess configuration complementary to said frustoconical configuration of said projection.

* * * * *